US008938836B2

(12) United States Patent
Chandra et al.

(10) Patent No.: US 8,938,836 B2
(45) Date of Patent: Jan. 27, 2015

(54) ABUTMENT STRUCTURES

(71) Applicants: Vijay Chandra, Fairfax Station, VA (US); John Sang Kim, Midlothian, VA (US)

(72) Inventors: Vijay Chandra, Fairfax Station, VA (US); John Sang Kim, Midlothian, VA (US)

(73) Assignee: PBC International Inc., New York, NY (US)

( * ) Notice: Subject to any disclaimer, the term of this patent is extended or adjusted under 35 U.S.C. 154(b) by 0 days.

(21) Appl. No.: 14/036,864

(22) Filed: Sep. 25, 2013

(65) Prior Publication Data

US 2014/0082864 A1 Mar. 27, 2014

Related U.S. Application Data

(60) Provisional application No. 61/705,273, filed on Sep. 25, 2012.

(51) Int. Cl.
*E02D 5/20* (2006.01)
*E02D 29/02* (2006.01)
*E01D 19/02* (2006.01)

(52) U.S. Cl.
CPC ..... *E01D 19/02* (2013.01); *E02D 29/0233* (2013.01); *E02D 5/20* (2013.01); *E02D 29/02* (2013.01)
USPC ..... 14/26; 14/74.5; 14/75; 14/77.1; 14/77.3; 405/285

(58) Field of Classification Search
CPC ..... E01D 19/02; E02D 29/02; E02D 29/0233
USPC ..... 14/26, 74.5, 75, 77.1, 77.3; 405/272–275, 282–285

See application file for complete search history.

(56) References Cited

U.S. PATENT DOCUMENTS

| | | | | |
|---|---|---|---|---|
| 4,564,967 | A * | 1/1986 | Vidal | 14/75 |
| 5,244,316 | A * | 9/1993 | Wright et al. | 405/285 |
| 5,551,809 | A * | 9/1996 | Forsberg | 405/285 |
| 5,789,477 | A | 8/1998 | Nosker et al. | |
| 5,791,826 | A * | 8/1998 | Moran | 405/284 |

(Continued)

FOREIGN PATENT DOCUMENTS

| | | | |
|---|---|---|---|
| KR | 0100496735 | B1 | 6/2005 |
| RU | 1821509 | A1 | 6/1993 |

(Continued)

OTHER PUBLICATIONS

Wang, Linan; Gong, Chao, "Abutments and Retaining Structures," Chapter 29, Bridge Engineering Handbook, Boca Raton: CRC Press, 2000, 37pgs.

(Continued)

*Primary Examiner* — Raymond W Addie
(74) *Attorney, Agent, or Firm* — Duane Morris LLP

(57) ABSTRACT

Abutment and bridge designs include a bridge superstructure and abutment wherein the abutment has a vertical portion of a backwall that can be fixedly joined to the end face of the bridge superstructure without an interdisposed expansion joint. A downward facing surface of the bridge superstructure can be fixedly joined to an upward facing surface of the abutment, or alternatively, a bearing pad may be disposed therebetween. The abutment may further comprise a backwall made from a plurality of panels fixedly joined to a plurality of supporting piles. The abutments and bridge superstructure may be made substantially from composite materials including recycled structural composite and other thermoplastics.

20 Claims, 8 Drawing Sheets

(56) References Cited

U.S. PATENT DOCUMENTS

| | | | | |
|---|---|---|---|---|
| 5,870,789 | A * | 2/1999 | Carranza-Aubry | 14/73 |
| 5,916,932 | A | 6/1999 | Nosker et al. | |
| 6,191,228 | B1 | 2/2001 | Nosker et al. | |
| 7,011,253 | B2 | 3/2006 | Nosker et al. | |
| 7,795,329 | B2 | 9/2010 | Nosker et al. | |
| 7,996,945 | B2 | 8/2011 | Nosker et al. | |
| 8,008,402 | B2 | 8/2011 | Lynch et al. | |
| 2009/0242655 | A1 | 10/2009 | Nosker et al. | |
| 2010/0319144 | A1 | 12/2010 | Nosker et al. | |
| 2011/0265410 | A1 | 11/2011 | Nosker et al. | |
| 2011/0294917 | A1 | 12/2011 | Lynch et al. | |

FOREIGN PATENT DOCUMENTS

| | | | |
|---|---|---|---|
| RU | 2005837 | C1 | 1/1994 |
| RU | 2299945 | C1 | 5/2007 |
| RU | 87712 | U1 | 10/2009 |
| SU | 1183597 | A | 10/1985 |
| WO | 02/29160 | A1 | 4/2002 |

OTHER PUBLICATIONS

Schut, Jan H., "They've Been Working on the Railroad," Plastics Technology, Apr. 2004, pp. 1-5.

International Searching Authority, International Search Report corresponding PCT International Application No. PCT/US2013/061689 mailed Jan. 30, 2014, 1pg.

International Searching Authority, International Search Report for corresponding PCT International Application No. PCT/US2014/030997, mailed Aug. 7, 2014, 1pg.

* cited by examiner

ABUTMENT STRUCTURES

This application claims the priority benefit of U.S. Provisional Patent Application No. 61/705,273, filed Sep. 25, 2012, the entirety of which is incorporated herein by reference.

FIELD

This disclosure relates generally to abutments, and more specifically to abutments having structures formed from composite materials and suitable for bridges, retaining structures, and the like.

BACKGROUND

As is known, abutments provide support to the ends of a bridge superstructure near where the bridge meets an approaching path, roadway, railway or the like. There are numerous types of known abutments, with varying degrees of complexity.

FIG. 1 shows an example of a prior art abutment 101 of a bridge 104 in the example of a roadway 107 spanning over stream 106 and streambed 105. Abutment 101 retains soil, rock and other materials, generally referred to as backfill 103, from the underpass of bridge 104. The depicted configuration of abutment 101 is generally referred to as an open end, seat type abutment. Abutment stem 130 is typically a vertical standing slab of poured concrete, providing major support for bridge superstructure 140. Abutment stem 130 has an abutment backwall 120 that retains backfill 103. Abutment 101 typically also has wingwalls (not shown) to further retain backfill 103. Part of backwall 120 extends upward between bridge superstructure 140 and the approaching roadway 107.

Abutment stem 130 is supported on piles 110 driven into the ground. Depending on the design constraints of the bridge, the piles 110 are typically made of steel, reinforced concrete or timber. Alternatively, abutment stem 130 can be supported on a footing structure (not shown), such as a horizontal section of concrete.

To provide protection from adverse corrosion and erosion phenomena and provide structural support to superstructure 140 while counter the loading from backfill 103, an embankment 109 is commonly required for many bridge designs. Embankment 109 slopes from its highest point midway along abutment stem 130 down to streambed 105 of the stream 106. Abutments having such an embankment are typically referred to as being an open end abutment. Embankment 109 is usually poured concrete or stone riprap, and provides support to abutment stem 130, including support against lateral forces from backfill 103. By ensuring that the top of embankment 109 is high enough on abutment stem 130, embankment 109 protects the integrity of the foundation and support structures under abutment stem 130 by preventing penetration of water, air and other elements down the abutment wall to the underlying support structure. Such penetration may otherwise cause erosion under and around abutment stem 130, as well as corrosion or decay of materials used for piles 110 or abutment footing (not shown).

The presence of embankment 109 can be problematic in that it restricts the amount of useable space available under the bridge stream 106, or other underlying road or waterway. For a given size of an underlying road or waterway, providing space for a sufficient embankment requires increasing the span size and cost of the bridge. It would be beneficial to have a closed end abutment (i.e. without an embankment) in circumstances where prior art designs required an open end design.

The seat structure shown in FIG. 1 provides an expansion joint 127 between the bridge superstructure 140 and the abutment 101. A bridge must accommodate, in some manner, environmentally and otherwise imposed events that make its structures move relative to one another, as is known for conventional materials used to build bridges, namely steel, concrete and timber. The movements are caused, for example, by thermal changes, concrete shrinkage, creep effects, elastic post-tensioning shortening, live loading, wind, seismic events, foundation settlement, and the like. Expansion joints like expansion joint 127 accommodate both cyclic and long-term structure movements to reduce secondary stresses in the structure. Although expansion joint 127 advantageously provides expansion space necessitated by prior art materials and designs, the space adversely permits infiltration of water, air, salt and other debris down the joint into the underlying substructure components, potentially causing erosion, corrosion and mechanical failures. It would be beneficial to remove or significantly reduce the complexity or need for expansion joints from bridge abutment designs.

As is typical, expansion joint 127 is accompanied by load bearing 137. Load bearing 137 facilitates the transfer of loads from bridge superstructure 140 down to abutment 101, while restricting and/or accommodating expected forces and movements. As is known, movement allowed by adjacent expansion joint 127 must be compatible with load bearing 137, and thus the two must be designed together and in consideration of the desired behavior of the overall structure. Load bearing 137 can be a complex component, and is susceptible to corrosion, wear and mechanical disruption from debris. As such, load bearing 137 can pose problematic design challenges, increase both initial costs and ongoing maintenance costs, and raise total costs of a given bridge over the life of the structure. It would be beneficial to have a bridge that removed or reduced the need or the complexity for load bearings used with abutments.

Although reference herein is repeatedly made to abutments in the context of bridge and retaining structures, one of ordinary skill in the art will recognize that the disclosed structures and methods are applicable to abutments used for other purposes.

Needed are abutments that do not have the extent and nature of one or more of the deficiencies of prior art abutments. Needed are abutments having one or more of the following properties: lower initial costs of manufacturer, lower total costs of ownership, lower inspection and maintenance costs, lower adverse environmental impact, no or less complex load bearings, and/or no or less complex expansion joints.

The abutments used in bridges and other civil engineering structures have long been designed using traditional materials, predominantly reinforced concrete, steel and timber. Over time, the extended use and testing of these materials, and the structures built with them, has resulted in a substantial knowledge base of their material properties, and the properties of structures built with them. This knowledge base includes a relatively well developed body of standards, codes, reference material, design texts and general knowledge in the industry pertaining to the conventional materials. This body of knowledge has, in some respects, hindered the development of new designs using new materials. For example, unconventional materials, such as plastics and composites have been disfavored in part because many applicable civil engineering designers do not know or have access to the same type of knowledge base as is available for steel, concrete and timber. Unconventional materials have further been disfavored in part because of perceived, and misperceived, challenges and differences between the materials and conventional materials, such as perceived differences in strength, temperature effects, and reactions to exposure, such as the effects of prolonged exposure to sunlight. It would be advantageous to realize the benefits of new materials and new designs using such materials, while overcoming or ameliorating one or more of the deficiencies of the prior art abutments.

DETAILED DESCRIPTION

Figure 1:
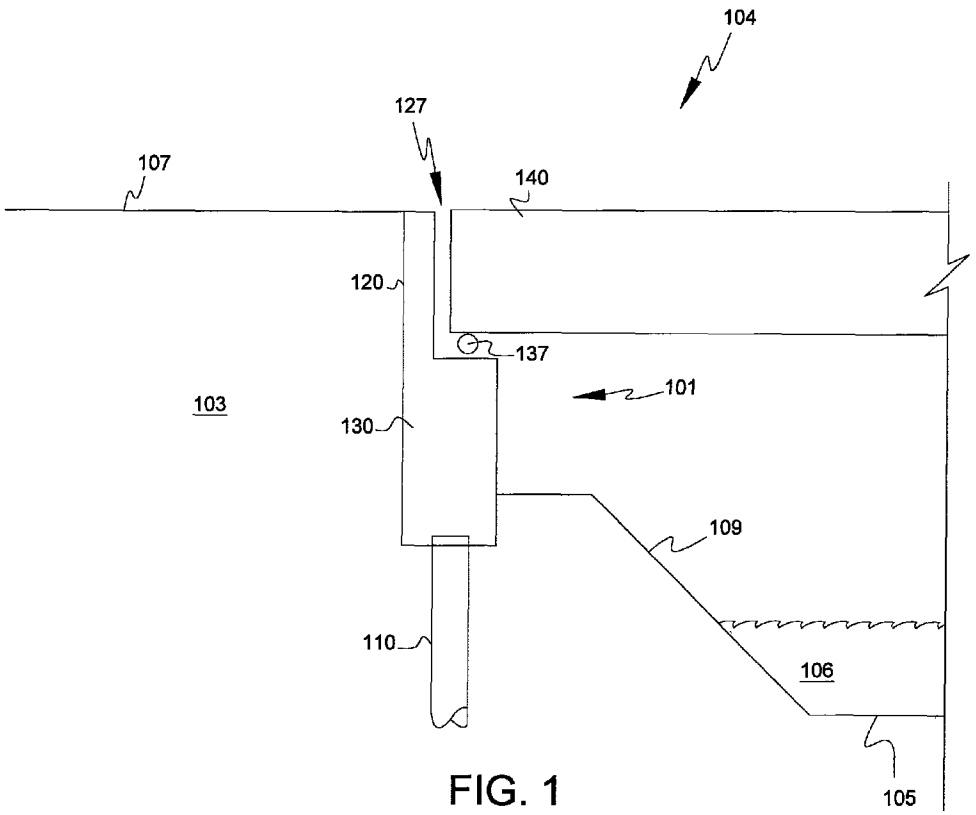
FIG. 1 PRIOR ART
FIG. 1 is an elevation cross-section of an open end, seat type abutment of the prior art.

Technical details of various disclosed examples and embodiments will now be described, it being understood that the present invention is broader than any particular example or embodiment. Technical details are provided for teaching purposes only and should not be considered in any way as a limitation on the scope of the invention. When referring to the Figures, like reference numerals are used for like components. For brevity purposes, the full description provided for one view is not repeated for the other views, it being understood that the description applies equally to the several views. In the various figures, broken lines are used to show portions of structures that are behind, and therefore hidden, from the perspective shown in that figure.

Thermoplastics are materials, particularly resins, that repeatedly soften when heated and harden when cooled. Some examples of thermoplastic resins include styrene, acrylics, cellulosics, polyethylenes, vinyls, nylons and fluorocarbons. Applicants have begun designing load bearing rail and roadway bridges using thermoplastics, and more specifically recycled thermoplastics, in a manner not previously accomplished. Applicants have been able to use these new composite materials to design bridge structures such as piles, pile caps, and girders.

One such thermoplastic, referred to as recycled structural composite or RSC, has been manufactured by Axion International Holdings, Inc. Axion manufactures structural composites in forms such as the I-Beam and T-Beams shown in FIGS. 9 and 10. Recycled plastic composites suitable for use with the present invention are disclosed in U.S. Pat. App. Publication 2011/0294917 to Lynch et al., Dec. 1, 2011, the entirety of which is hereby incorporated by reference. In particular, Lynch discloses a recycled plastic structural composite formed from a mixture of high density polyolefin together with one or both of a thermoplastic-coated fiber material and a polystyrene, poly (methyl methacrylate). Other suitable composites are known or can be found in the literature and applied based on the teachings herein.

Applicants designed railroad bridges using RSC structural components that were field tested in Fort Eustis, Va. in the Spring of 2010. The Fort Eustis bridges were approximately 40 feet and 80 feet long with a load capacity of approximately 130 tons, with a Cooper E-60 rating. Some of the bridge structures, including the piles, span girders, piers, bumpers and rail ties, were made from nearly 100 percent recycled post-consumer and industrial plastics.

Thermoplastic materials can have distinct advantages as compared to conventional materials in that they are less susceptible to decay, such as the rotting experienced in timber structures, less susceptible to oxidation and corrosion, such as the rust experienced in steel and reinforced concrete structures, and are impervious to insects, a concern for timber. Environmental benefits of many thermoplastics include that the material is inert and will not leach, or is much less susceptible to leaching, potentially harmful chemicals into the environment. This may be particularly beneficial, for example, when building bridges near or on waterways, and especially important for projects near wetlands or other protected bodies of water.

Figure 2:
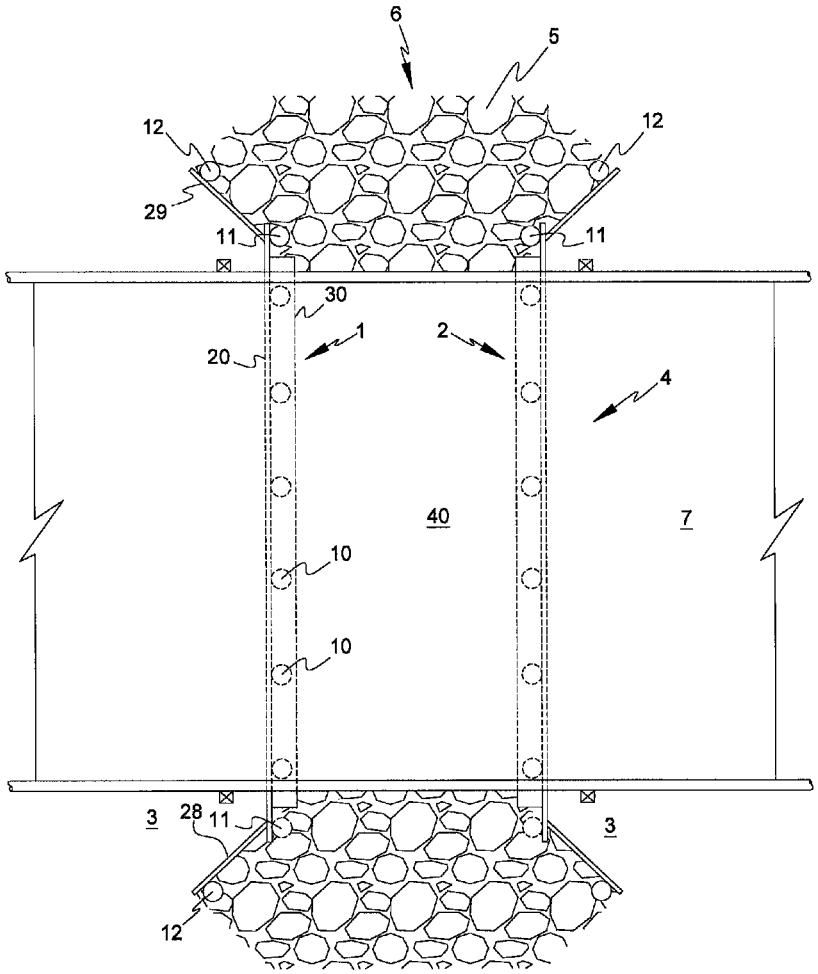
FIG. 2 is a plan view of a roadway, bridge and two abutments in accordance with an embodiment of the present invention.

FIG. 2 depicts a plan view of a roadway 7, bridge 4 and two abutments 1, 2 in accordance with one embodiment. Stream 6 flows over stream bed 5 under roadway 7. On the left side of stream 6, abutment 1 supports bridge superstructure 40 and retains soil, rock and other material, generally referred to as backfill 3. In some embodiments, backfill 3 can be non-frost susceptible sand and gravel, or other known materials. Abutment 1 provides lateral and vertical structural support to bridge 4. Abutment 1 includes a backwall 20 and wingwalls 28, 29. A number of piles 10 are driven deep (in some embodiments 40 to 50 feet) into the streambed 5 at locations spaced along one side of stream 6 directly under bridge 4. Piles 11 and 12 are also driven into streambed 5, but are not located under bridge 4. Piles 10, 11 and 12 can be made of RSC and can be about 12" in diameter or greater. Piles 10, as well as 11 and 12, are driven into the ground along an edge of backfill 3 that is to be retained from entering the underpass area of bridge 4.

Abutments 1, 2 are closed end abutments. In such embodiments, there is no need for an embankment because the RSC structures are resistant to the corrosion concerns of conventional materials and the structural design disclosed is sufficient to counteract the lateral force of the backfill. The lack of an embankment permits a smaller bridge for a given underpass capacity requirement, and conversely, permits a larger underpass capacity for a given bridge size.

Backwall 20 is affixed to piles 10 and 11. Wingwalls 28, 29 are affixed to piles 11, 12. Backwall 20 and wingwalls 28, 29 can each be about 3" thick or greater, and can be built from RSC panels. A pile cap 30 rests on the six piles 10 of Abutment 1 located under the bridge superstructure 40. Pile cap 30 can be a RSC girder having the cross-section shown in FIG. 9 or 10. Similar to abutment 1, abutment 2 supports the bridge on right side of stream 6. Abutment 1 and abutment 2 are identical. The description of components for abutment 1 is equally applicable to abutment 2, and is not repeated for brevity purposes. In some embodiments, abutment 2 has the same primary structural components as abutment 1. In various embodiments, modifications within the skill of one of ordinary skill in the art can be made to one or both abutments 1, 2.

Figure 3:
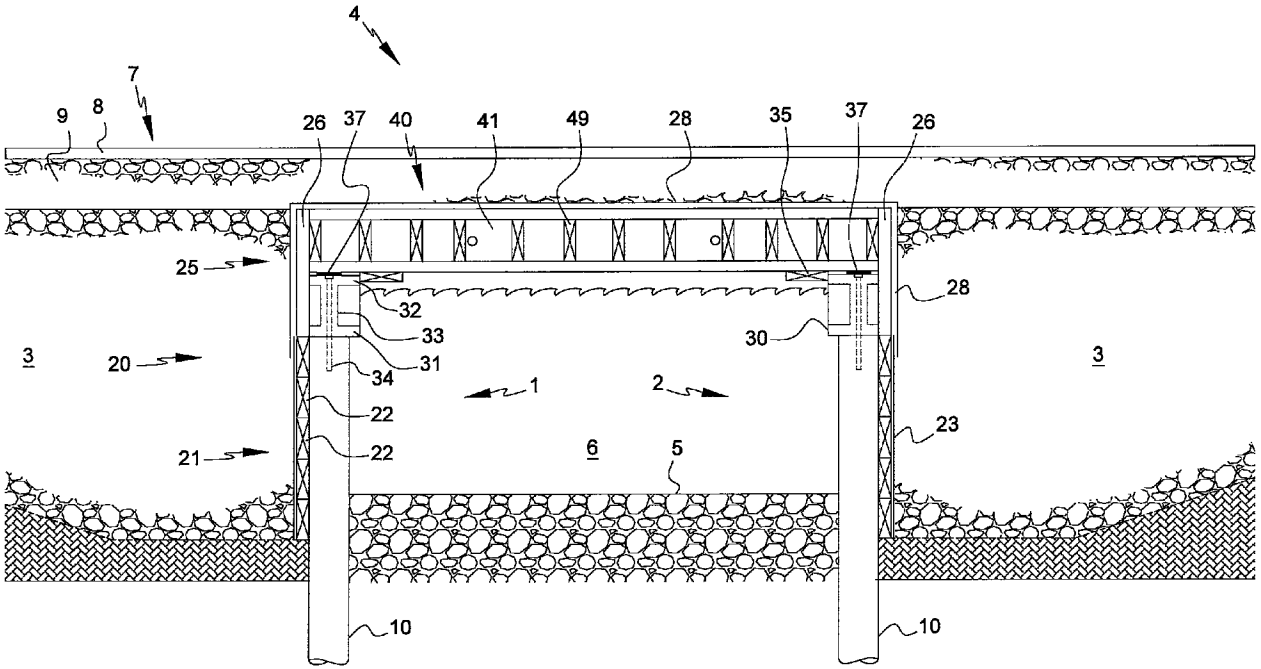
FIG. 3 is an elevation cross-section view of the roadway, bridge and two abutments of the embodiment shown in FIG. 2.

FIG. 3 depicts an elevation view of abutments 1, 2, roadway 7 and bridge 4 of the embodiment shown in FIG. 2. Roadway 7 can include any typical materials, such as asphalt 8 over a layer of aggregate subgrade 9. For clarity purposes, the wingwalls 28, 29 and associated wingwall piles 11, 12 of FIG. 2 are not shown in FIG. 3. As depicted, backwall 20 is made of a lower backwall 21 and an upper backwall 25. Lower backwall 21 is made of horizontal RSC panels 22, which are affixed along the edges of piles 10 of abutment 1 and adjacent to one another to form a barrier that separates stream 6 from backfill 3. The horizontal RSC panels 22 retain backfill 3 from entering the underpass of bridge 4. The horizontal RSC panels 22 extend from about the height of piles 10 down to the bottom limit of the excavation adjacent bridge 4. In this particular embodiment, the excavation is just over a foot deeper than the streambed 5, or approximately the width of one horizontal RSC panel 22.

Upper backwall 25 is formed from a series of vertical RSC panels 26, only one of which is viewable in FIG. 3. Vertical RSC panels 26 can be about 3" thick or greater. Vertical RSC panels 26 are affixed to pile cap 30. As can be seen in FIG. 3, the lower flange 31 and upper flange 32 of pile cap 30 are not symmetric about web 33. The flanges 31, 32 are shorter on one side of the figure to permit upper backwall 25 and lower backwall 21 to be coplanar and adjacent to one another, forming a continuous backwall 20 to retain backfill 3. The asymmetric flanges of pile cap 30 permits the cap to be centered over piles 10. Bolts 34 can be used to secure pile cap 30 to piles 10. Bolts 34 can extend through web 33 and secured into the centerline of each of piles 10.

In some embodiments, lower backwall 21 may be affixed to the side of piles 10 facing the underpass, such that lower backwall 21 and upper backwall 25 are not coplanar.

Figure 10:
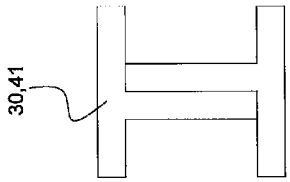
FIG. 10 is an elevation view of the end face of an I-Beam formed from two T-Beams to form a girder used in the embodiment shown in FIG. 2.

Superstructure 40 of bridge 4 has a series of 18" RSC I-Beam girders 41 to support roadway 7, only one of which is viewable in FIG. 3. Girders 41 of superstructure 40 can have a cross-section as shown in FIG. 10. A plurality of shear blocks 49 can be added in voids of girders 41 to add strength. Shear blocks 35 can be affixed under girders 41 to abut the interior facing edges of upper flanges 32 of pile caps 30.

Figure 8:
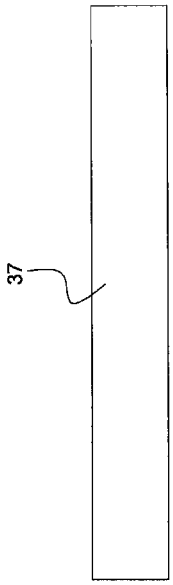
FIG. 8 is a plan view of a bearing pad used in the embodiment shown in FIG. 2.

Elastomeric bearing pads 37 are disposed between pile cap 30 and girders 41 of superstructure 40. An elastomeric bearing pad 37 is shown in FIG. 8. Advantageously, no further load bearing is required and the elastomeric bearing pad 37 is robust and lacks the complexity of prior art load bearings 137. Shear blocks 35 can be affixed to girders 41 to provide support against translational relevant movement between girders 41 and pile caps 30. Advantageously, there is no expansion joint 127 needed between the abutments 1, 2 and superstructure 40 due to the thermo-mechanical properties of the disclosed design of the composite material based bridge 4.

For lower backwall 21, liner 23 can be used to line the surface of the backwall 20 that faces backfill 3. In some embodiments liner 23 can be an 8 ounce non-woven geotextile filter fabric that filters liquids that might seep through lower backwall 21. A waterproof membrane 28 can extend along the top of girders 41 of bridge superstructure 40, down the outside of the vertical RSC panels 26 of upper backwalls 25. In some embodiments waterproof membrane 28 overlaps filter fabric 23, with an overlap of at least 6". Waterproof membrane 28 prevents infiltration of water and debris between the components of superstructure 40 and abutments 1 and 2.

As shown in FIG. 3, the waterline of stream 6 is just below bridge superstructure 40, continually exposing much of bridge 4 and its abutments 1, 2 to water, salt and debris. Advantageously, composite materials such as RSC and other thermoplastics do not present the same corrosion and decay concerns as the conventional materials discussed above. Thermoplastics such as RSC are also less likely to leach hazardous materials into stream 6 as compared, for example, to chemically treated timber.

Figure 4:
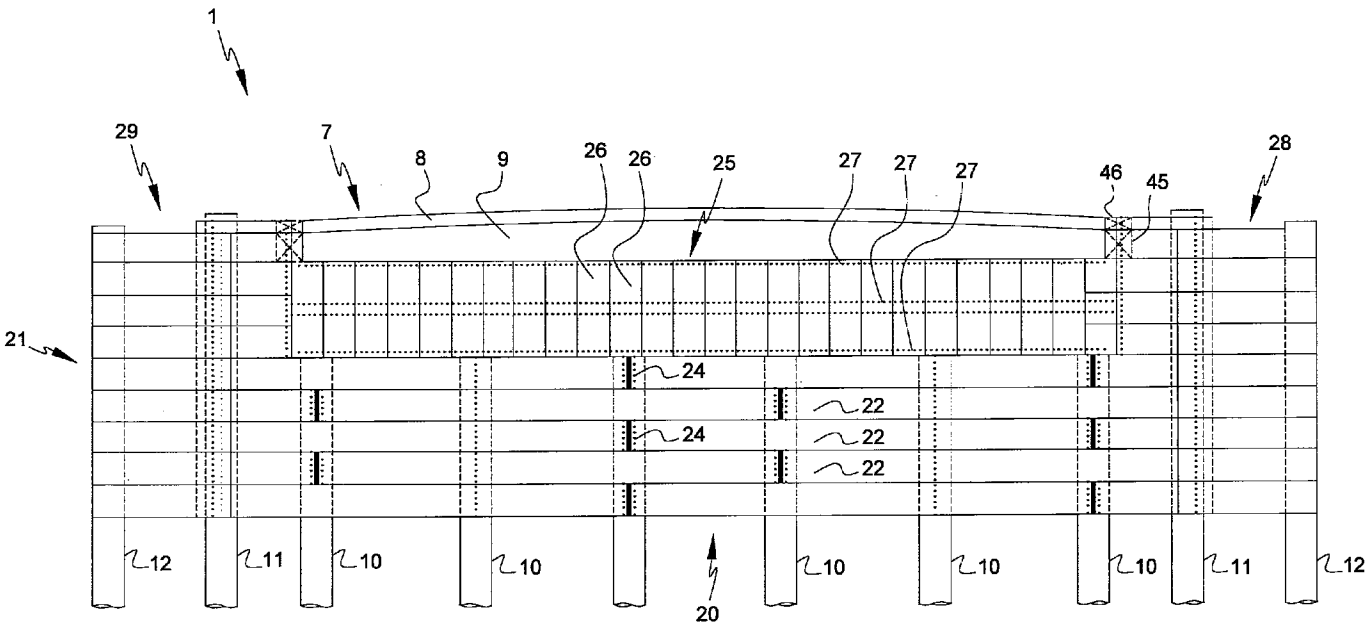
FIG. 4 is an elevation view from the backfill side of one of the abutments of the embodiment shown in FIG. 2.

FIG. 4 depicts backwall 20 and two wingwalls 28, 29, as viewed from the backfill 3 side of abutment 1. A cross section of roadway 7 is depicted, with six piles 10 thereunder. The backwall 20 is formed from five rows of horizontal 3" or thicker RSC panels that are fixedly joined to the piles using screws 24. Preferably, horizontal panels 22 are staggered among piles 10, 11 and 12 as shown. Embodiments in which the backwall 20 is disposed between backfill 3 and piles 10, as shown in FIG. 4, have an advantage in that the loading from the backfill provides a compression force between backwall 20 and piles 10, avoiding putting tension on screws 24. Wingwalls 28, 29 are affixed to piles 11, 12. Piles 11, 12 extend to the top of wingwalls 28, 29 whereas piles 10 extend to the bottom of lower flange of pile cap 30 (not shown in FIG. 4).

Upper backwall 25 extends from lower backwall 21 to roadway 7. Upper backwall 25 is formed with vertical panels 26, which can be 3"×12" or thicker panels made of a composite material such as RSC. As is shown, each of the vertical panels 26 can be fixedly joined by a series of screws 27 to the top and bottom flanges of the girders 41 of the bridge superstructure 40, and to the top and bottom flanges of pile cap 30. Thus, in some embodiments, the upper backwall 25 is directly affixed to bridge superstructure 40 without an expansion joint 127 of the prior art.

Figure 5:
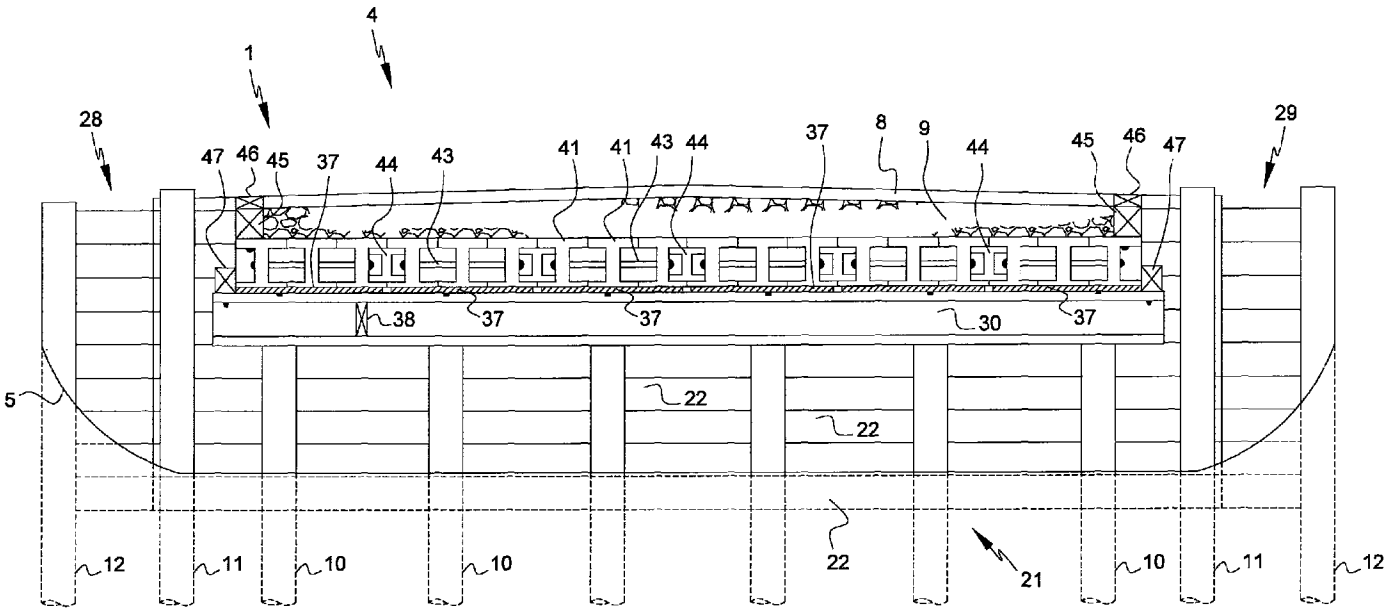
FIG. 5 is an elevation cross section of the roadway and bridge of the embodiment shown in FIG. 2, viewed from the interior of the bridge.
Figure 9:
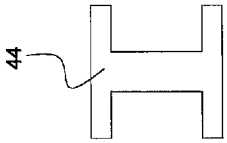
FIG. 9 is an elevation view of the end face of an I-Beam used in the embodiment shown in FIG. 2.

FIG. 5 depicts a cross section of roadway 7 and bridge 4, viewed from the underpass side of abutment 1. Lower backwall 21 extends about the width of one horizontal panel 22 below streambed 5. Girders 41 rest on top of a plurality of elastomeric bearing pads 37. Each set of three girders 41 is secured together using a tie rod 43. Adjacent sets of girders 41 are adjoined with a smaller I-Beam 44 embedded in the voids between the flanges of adjacent girders 41 of two adjacent sets. The smaller I-Beams 44 are shown in FIG. 9. I-Beams 44 can be made of a composite material, such as RSC. Retainer blocks 45 and 46 can be secured to the outer girders 41 to retain materials of roadway 7. Retainer blocks 45 and 46 can be made of a composite material, such as RSC. Transverse shear blocks 47 are secured at the ends of pile cap 30 and provide transverse support for girders 41. A plurality of shear blocks 38 (only one of which is shown) can be disposed in the void between flanges of pile cap 30. Shear blocks 38 can have a width of about 3 inches or greater and can be spaced along the length of pile cap 30 as necessary for strength. For example, for a pile cap 30 that is about 28 feet, six inches long, in some embodiments shear blocks 38 can be spaced about every 18 inches along the length of pile cap 30. The retainer and shear blocks disclosed herein can be made of a composite material, such as RSC.

A plurality of the 1"×7"×52" non-laminated elastomeric bearing pads 37 shown in FIG. 8 are disposed along the top of pile cap 30, providing a simple interface to support girders 41. In this particular example, a bearing pad 37 has a length chosen to correspond to the width of each modular set of three girders 41 joined together as shown in FIG. 5. Advantageously, the simple bearing pads 37 accommodate the expected movements and behavior of the overall bridge 4, but do not suffer the deficiencies of the more complex load bearings 137 of the prior art described with respect to FIG. 1. In an alternative embodiment (not shown), the superstructure girders may be directly affixed to the pile cap 30, or other component of abutment 1.

Figure 6:
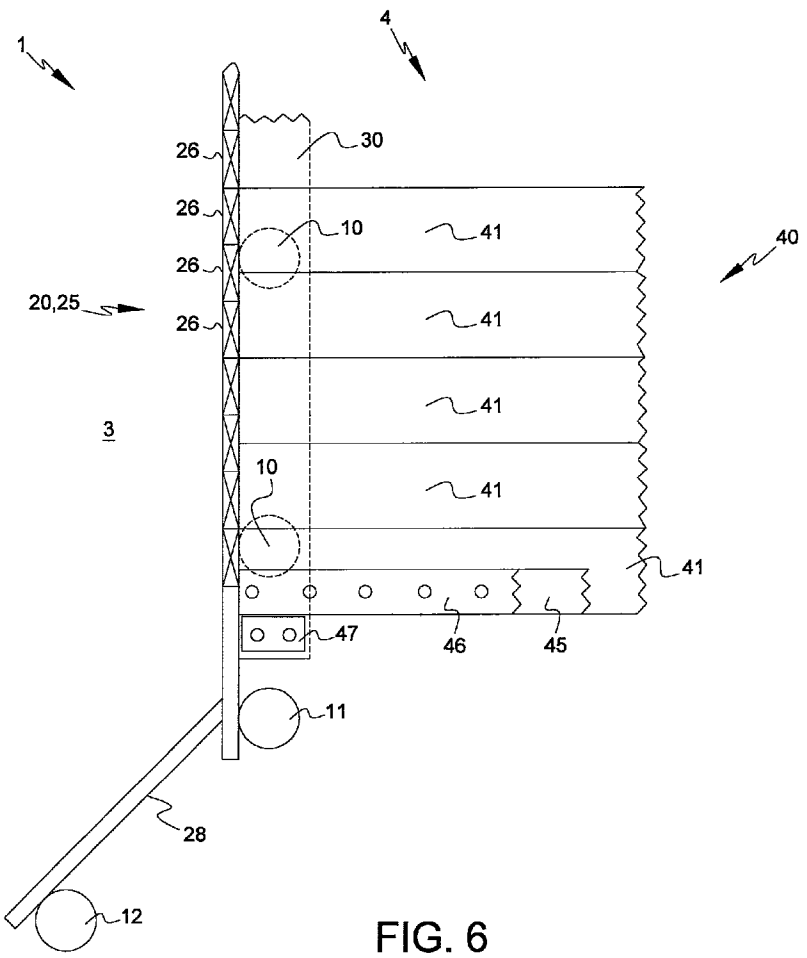
FIG. 6 is a partial plan view of a portion of the bridge and one of the abutments of the embodiment shown in FIG. 2.

FIG. 6 depicts a plan view of a portion of bridge 4 and abutment 1. The vertical panels 26 of upper backwall 25 abut the end faces of girders 41 of superstructure 40, as well as the flanges of the pile cap 30. Pile cap 30 rests on piles 10. Wingwall 28 is secured to backwall 20 near pile 11.

Figure 7:
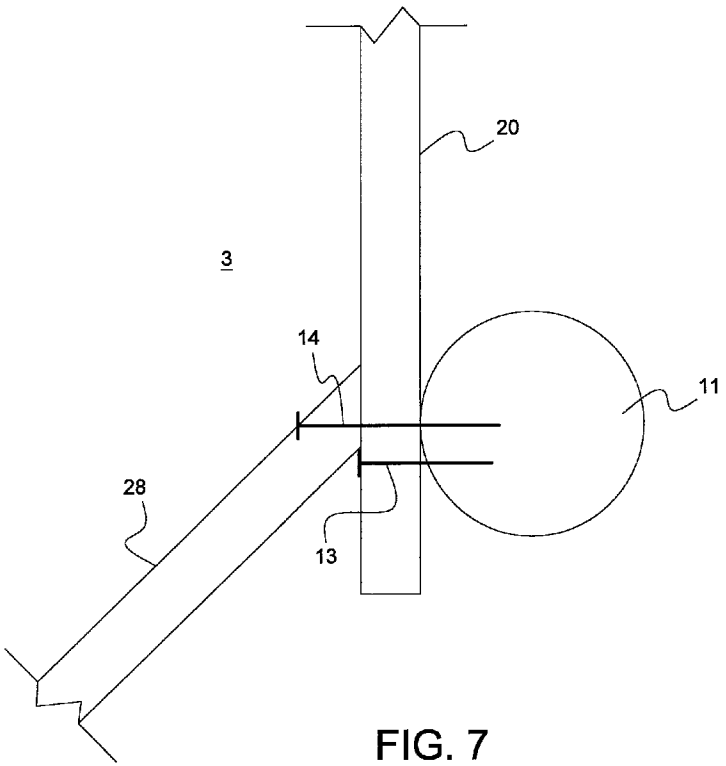
FIG. 7 is a partial plan view of the wingwall fastener detail of the embodiment shown in FIG. 2.

FIG. 7 depicts the fastener detail of backwall 20 and wingwall 28. Backwall 20 is secured to pile 11 using screws 13 spaced along the vertical length of pile 11. Wingwall 28 is secured to backwall 20 and pile 11 using screws 14 spaced along the vertical length of pile 11.

The disclosed embodiments remove or reduce the deficiencies of the prior art as discussed above. In some embodiments, advantages of composite materials are realized for abutments and superstructures. In some embodiments, the abutments and superstructure work together as a unit, compensating for temperature induced expansion and contraction associated with the particular RSC composites, in the context of the overall structural behavior of the bridge and the loads imposed on it. In some embodiments, the disclosed designs overcome or reduce one or more deficiencies associated with prior art bridges and abutments.

In a first aspect, disclosed is an abutment having structural members made of a composite material and suitable to support a superstructure of a bridge. The abutment includes a plurality of piles made of a composite material and driven into the ground along an edge of material to be retained. The abutment includes a pile cap affixed to, and supported on top of, the plurality of piles with the pile cap and the plurality of piles adapted to support the superstructure. The abutment includes a plurality of horizontal abutment panels made of a composite material and fixedly joined to the piles and disposed adjacent one another, with the horizontal abutment panels and piles adapted to retain the material.

In a second aspect, disclosed is an abutment having structural members made of a composite material. The abutment includes a plurality of piles made of a composite material and driven into the ground along an edge of material to be retained. The abutment includes a plurality of horizontal abutment panels made of a composite material and fixedly joined to the piles adjacent one another to retain the material.

In a third aspect, disclosed is a bridge having structural members made of a composite material. The bridge has a first abutment that includes one or more structural members made of a composite material. The bridge has a second abutment that includes a plurality of piles made of a composite material and driven into the ground along an edge of material to be retained. The second abutment has a pile cap affixed to, and supported on top of, the plurality of piles, with the pile cap and plurality of piles adapted to support a superstructure of the bridge. The second abutment includes a plurality of horizontal abutment panels made of a composite material and fixedly joined to the plurality of piles and disposed adjacent one another, the plurality of horizontal abutment panels and piles adapted to retain the material.

In some embodiments, the pile cap is made from a composite material.

In some embodiments, the horizontal abutment panels are made of one or more composite materials selected from the group consisting of: recycled structural composite, recycled thermoplastic, virgin plastic, particle board, and combinations thereof. In some embodiments, the horizontal abutment panels are made of recycled structural composite.

In some embodiments, the horizontal abutment panels are affixed to the side of the piles that faces the material to be retained.

In some embodiments, the abutment is a closed-end abutment. In some embodiments, the plurality of horizontal abutment panels forms at least a portion of a backwall that is disposed between the material to be retained and a waterway that partially submerges one side of the backwall.

In some embodiments, a bearing pad is disposed between the pile cap and the superstructure to transfer load there between.

In some embodiments, the pile cap is fixedly joined directly to the superstructure without a load bearing.

In some embodiments, the plurality of horizontal abutment panels forms a lower backwall and the abutment further comprises an upper backwall having a plurality of vertical abutment panels made from a composite material and fixedly joined to the pile cap, the vertical abutment panels disposed adjacent one another. In some embodiments, the upper backwall and the lower backwall are coplanar and adjacent to one another. In some embodiments, the upper backwall extends higher than the pile cap and an interior surface of the upper backwall extending above the pile cap faces the superstructure. In some embodiments, the interior surface of the upper backwall is secured directly to an end of the superstructure without an expansion joint therebetween. In some embodiments, a portion of the lower backwall extends at least six inches below the surface of the bed of the waterway.

In some embodiments, a waterproof membrane disposed on an upper surface of the superstructure extends across to an upper surface of the upper backwall to prevent water from infiltrating between the superstructure and the upper backwall. In some embodiments, the waterproof membrane extends further down the outer facing sides of the upper backwall and the lower backwall to further prevent infiltration of water therebetween.

In some embodiments, a first end of the superstructure is laterally secured directly to an interior facing portion of the first abutment of a bridge and a second end of the superstructure is laterally secured directly to an interior facing portion of the second abutment of the bridge, whereby the bridge superstructure is secured to both abutments without the use of an expansion joint. In some embodiments, the first and the second abutments are each closed-end abutments.

One of ordinary skill in the art will appreciate that the detailed description of the various embodiments is exemplary in nature, and that further embodiments and variations can be realized without departing from the spirit and scope of the invention, which is to be understood with reference to associated patent claims. It is to be understood that the invention is not limited to the specific embodiments described. One of ordinary skill in the art will appreciate, for example, that the structures disclosed may be formed alternatively from a single component, or multiple subcomponents. Likewise it will be appreciated that although reference has been made to a specific example of using RSC as the composite, one of ordinary skill in the art would understand that the structures disclosed could be formed using other composites. One of ordinary skill will appreciate that the structures described herein may be adapted to a set of design parameters corresponding to a particular need for a bridge or retaining wall without departing from the scope and spirit of the invention.

We claim:

1. An abutment having structural members made of a composite material and suitable to support a superstructure of a bridge, the abutment comprising:

a plurality of piles made of a composite plastic material and driven into the ground along an edge of material to be retained;

a pile cap affixed to, and supported on top of, said plurality of piles, said pile cap and said plurality of piles adapted to support said superstructure; and a plurality of horizontal abutment panels made of a composite plastic material and fixedly joined to said piles and disposed adjacent one another, said horizontal abutment panels and piles adapted to retain said material.

2. The abutment of claim 1, wherein said pile cap is made from a composite plastic material.

3. The abutment of claim 1, wherein said horizontal abutment panels are made of one or more composite materials selected from the group consisting of: recycled structural composite, recycled thermoplastic, virgin plastic, particle board, and combinations thereof.

4. The abutment of claim 1, wherein said horizontal abutment panels are made of recycled structural composite.

5. The abutment of claim 1, wherein said horizontal abutment panels are affixed to the side of said piles that faces said material to be retained.

6. The abutment of claim 1, wherein the abutment is a closed-end abutment.

7. The abutment of claim 1, wherein a bearing pad is disposed between said pile cap and said superstructure to transfer load there between.

8. The abutment of claim 1, wherein said pile cap is fixedly joined directly to said superstructure without a load bearing.

9. The abutment of claim 1, wherein said plurality of horizontal abutment panels forms a lower backwall and said abutment further comprises an upper backwall having a plurality of vertical abutment panels made from a composite plastic material and fixedly joined to said pile cap, said vertical abutment panels disposed adjacent one another.

10. The abutment of claim 9, wherein said upper backwall and said lower backwall are coplanar and adjacent to one another.

11. The abutment of claim 9, wherein said upper backwall extends higher than said pile cap and an interior surface of said upper backwall extending above said pile cap faces said superstructure.

12. The abutment of claim 11, wherein said interior surface of said upper backwall is secured directly to an end of said superstructure without an expansion joint therebetween.

13. The abutment of claim 12, wherein a waterproof membrane disposed on an upper surface of said superstructure extends across to an upper surface of said upper backwall to prevent water from infiltrating between the superstructure and the upper backwall.

14. The abutment of claim 13, wherein said waterproof membrane extends further down the outer facing sides of said upper backwall and said lower backwall to further prevent infiltration of water therebetween.

15. The abutment of claim 1, wherein said plurality of horizontal abutment panels forms at least a portion of a backwall that is disposed between said material to be retained and a waterway that partially submerges one side of said backwall.

16. The abutment of claim 15, wherein a portion of said lower backwall extends at least six inches below the surface of the bed of the waterway.

17. An abutment having structural members made of a composite material, the abutment comprising:

a plurality of piles made of a composite plastic material and driven into the ground along an edge of material to be retained; and a plurality of horizontal abutment panels made of a composite plastic material and fixedly joined to said piles adjacent one another to retain said material.

18. A bridge having structural members made of a composite material, the bridge comprising:

a first abutment including one or more structural members made of a composite plastic material; and a second abutment including:

a plurality of piles made of a composite plastic material and driven into the ground along an edge of material to be retained;

a pile cap affixed to, and supported on top of, said plurality of piles, said pile cap and plurality of piles adapted to support a superstructure of said bridge; and a plurality of horizontal abutment panels made of a composite plastic material and fixedly joined to said plurality of piles and disposed adjacent one another, said plurality of horizontal abutment panels and piles adapted to retain said material.

19. The bridge of claim 18, wherein a first end of said superstructure is laterally secured directly to an interior facing portion of said first abutment and a second end of said superstructure is laterally secured directly to an interior facing portion of said second abutment, whereby the bridge superstructure is secured to both abutments without the use of an expansion joint.

20. The bridge of claim 18, wherein said first and said second abutments are each closed-end abutments.

* * * * *